US005283514A

United States Patent [19]

Hayward et al.

[11] Patent Number: 5,283,514

[45] Date of Patent: Feb. 1, 1994

[54] FAST RESPONSE CURRENT REGULATOR FOR DC POWER SUPPLY

[75] Inventors: C. Michael Hayward, Harvard; Xioa-Wei Dai, Worcester, both of Mass.

[73] Assignee: Hybricon Corporation, Ayer, Mass.

[21] Appl. No.: 941,391

[22] Filed: Sep. 8, 1992

[51] Int. Cl.[5] ..... G05F 1/575

[52] U.S. Cl. ..... 323/280; 323/273

[58] Field of Search ..... 323/311, 313, 314, 273, 323/274, 280, 281

[56] References Cited

U.S. PATENT DOCUMENTS

| | | | |
|---|---|---|---|
| 4,952,867 | 8/1990 | Anderson et al. | 323/273 |
| 4,912,423 | 3/1990 | Milkovic et al. | 330/9 |
| 5,177,431 | 1/1993 | Smith et al. | 323/274 |
| 5,194,802 | 3/1993 | Hill et al. | 323/280 |

OTHER PUBLICATIONS

Application Note #6, TachoMOD Demonstration Board, Vicor Corporation, Andover, Massachusetts (Jul. 1991).

Jay Prager, "Beyond Distributed Power," Vicor Corporation, Andover, Mass. (Dec. 21, 1990).

*Primary Examiner*—Jeffrey Sterrett

*Attorney, Agent, or Firm*—Schiller & Kusmer

[57] ABSTRACT

A current regulating, transconductance amplifier is connected to the load capacitor of a backplane system. The load capacitor is connected close to the load inside the feedback loop of the regulating amplifier. The frequency response shaping networks of the amplifier are designed to include the pole and zero, contributed by this capacitor, to meet the criteria for fast settling of a current step at the load. At least in the location of the load capacitor and the current feedback paths between each sense point and the transconductance amplifier of the regulator the dielectric thickness of the dielectric material is made as thin as possible, consistent with manufacturability and voltage breakdown (currently on the order of seven mils thick), and the current paths between the transconductance amplifier and each of the sense points (for detecting changes in load current) are made parallel to one another on opposite sides of the dielectric material so that the current in the two paths follow equal and opposite parallel directions. This results in the interaction of the electromagnetic fields created by the two currents drawn at the sense points so that they cancel one another so as to reduce the parasitic impedance of these current paths.

8 Claims, 9 Drawing Sheets

FAST RESPONSE CURRENT REGULATOR FOR DC POWER SUPPLY

FIELD OF INVENTION

The present invention relates to an improved current regulator, and more particularly to an improved current regulator having a very fast response time and particularly adapted for use as a part of a DC distributive power supply connected to a backplane system.

BACKGROUND OF THE INVENTION

Distributive power supplies have found wide application, as, for example, in telecommunications and data processing systems. This class of power supply provides an advantage over bulk power systems by reducing parasitic reactances between the power supply and components connected to the supply. See Application Note #6, TachoMOD Demonstration Board, Vicor Corporation, Andover, Mass., July 1991; and Prager, Jay, "Beyond Distributed Power", Vicor Corporation, Andover, Mass. Dec. 21, 1990. In general these power supplies provide a source of power to a common bus system (known as a "backplane" system) so that high speed digital signals can be transmitted among various components all connected to the backplane system so as to form a larger electronic system.

Backplane systems or motherboards are widely used today to overcome numerous problems arising out of the huge number of wires often required to effect connections between cardedge connector pins. The term "backplane" is understood to refer to a board or sheet of electrically insulating material, such as a glass-epoxy composite, provided with a plurality of electrically conductive channels or busses that run parallel to one another across one or more surfaces of the backplane between one or more male or female electrical connectors coupled to the busses. The backplane can be thus considered as the neural network of an electronic system in that it provides the interconnection of components of the system, usually in the form of various "function boards" or "daughter boards", each comprising a multiplicity of printed circuit boards.

In a bussed backplane, the majority of the interconnections are formed by contacts on connectors provided on each function or daughter board. The contacts are typically oriented perpendicular to the direction of the bussed connections at locations on the backplane called slots. Such backplanes may also have point to point connections which go from a contact on one connector to a single point on another connector. There may also be connections that interconnect more than two points but which are not fully bussed or have no bussed section.

As the demands of increased operating speeds on backplane systems have increased, so have the performance demands on distributive, power sources. For example, BTL systems have recently been developed, such as the Futurebus+ system manufactured and sold by the present assignee, Hybricon Corporation of Ayer, Mass., which allow much faster propagation time of digital signals through the backplane bus, than previously achieved by the earlier Versa-module Europe (VME) system.

The former VME system uses TTL logic for each transceiver connected to the bus. As such there is a larger capacitive load which slows down signal propagation in a VME system. Furthermore, as the result of TTL logic, a greater swing of voltage is required between the high and low states of the digital signals on the bus. In order to reach the TTL logic threshold, a change in the signal voltage on the bus must travel past all of the slots of the bus in the forward direction; then reflect back to the source. Consequently, these VME systems are ref erred to as second incident wave systems.

BTL systems, on the other hand, employ a family of transceivers with much lower parasitic output capacitance so that the signal propagation delay is reduced and with smaller voltage swing so that "incident" wave switching systems can be provided. This family of transceivers, specified in the IEEE 1194.1 documentation, has become the basis for a high performance computing system such as the Futurebus+ system. Known as Backplane Transceiver Logic, or BTL, this transceiver family has also become popular for computer and telecommunications applications. A BTL transceiver is an open collector device with a series Schottky Barrier diode for isolating the collector capacitance from the bus when the transceiver is off (in the high state).

For effective transmission of high speed digital signals in backplanes using the incident wave mode of operation, each bussed transmission line must be terminated at each end with a resistive termination $R_T$ (see FIG. 1) which matches the characteristic impedance of the line provided by the bus. Furthermore, these termination resistors need to be connected to a power source so that the resistors act as pullups when a particular line changes from a low state to a high state, and thus provide the means of establishing the logic high level voltage on the bus as the default state. As is well known, the bus voltage must be then switched from high to low, by transceivers located on the function and daughter boards that plug into the backplane at various slot positions (shown for example at $SL_1$ through $SL_7$ in FIG. 1) when a low state is initiated. The termination resistors $R_T$, located at each end of the bus, are connected to a power source $V_T$, so as to provide the proper voltage level, typically set at $2.1^V$ DC, which establishes a logic high level equal to the power source voltage. This is also shown in FIG. 1. The nominal logic low voltage is approximately $1^V$ DC and the nominal, mean threshold voltage is approximately $1.54^V$ DC. FIG. 1 shows the various voltage limits. Transition times between the high and low states vary typically between 2ns. and 5ns., but can be faster.

As a result a signal voltage front (caused by a change in state) travels down a backplane past each slot and does not reflect back appreciably (and for this reason is referred to as an "incident wave switching" system). The signal can be accepted by any board. Theoretically, a transceiver driver can put another change of signal on the backplane before the signal front of the previous one has reached the end of the backplane.

The requirement, problems and solutions described herein, are described in connection with the transmission of high speed digital signals on backplane systems and, preferably in bussed backplane interconnection systems that will support incident wave switching operation of the system. Incident switching, by its nature, places very serious demands on the speed and signal integrity capability of the system. However, the application, problems and solutions described herein, are appropriate for a wider range of backplane system applications.

In order to understand the problems of the prior art reference is made to FIG. 2. FIG. 2 shows a simplified representation of one end of a typical backplane signal transmission system meeting the Futurebus+ specification, wherein two of the slots n−1 and n are shown connected to 64 data bit lines of the signal bus 10 connected to the pullup, terminating resistors $R_{t1}$–$R_{t64}$. Each successive pair of data bit lines $R_{t1}$ and $R_{t2}$, $R_{t3}$ and $R_{t4}$, . . . $R_{t63}$ and $R_{t64}$ have their terminating resistors connected as a pair to the ground plane of the backplane through a single bypass capacitor $C_3$.

Capacitor $C_3$ is preferably a ceramic (i.e., tantalum and aluminum electrolytic) capacitor connected in parallel to one or two stages of larger or main capacitors $C_2$ and $C_1$, as well as the power supply 12, all of which have one plate or terminal connected to the ground plane. The larger capacitors are provided in order to supply charging current to each successively smaller capacitor. Capacitors $C_{3,1}$; $C_{3,2}$ . . . $C_{3,n}$ are the primary source of stored energy needed to supply current to the termination resistors $R_T$, initially, at the moment a transceiver switches T on, and likewise, absorb the excess current when the transceiver switches off. They will discharge (or charge) at an initial rate determined by the maximum current demand which can be a number of amperes when the maximum possible number of lines switch simultaneously. When one of the data bit lines changes state from a high state to a low state, for example, charge is pulled from the corresponding capacitor $C_3$, resulting in a decrease in voltage across this capacitor. For stability of the high voltage state of reference voltage provided across the terminating resistor on the line, the capacitor must be charged as quickly as possible. By making capacitor $C_2 >> C_3$, and $C_1 >> C_2$, the discharging capacitor $C_3$ will be quickly charged by capacitor $C_2$, which in turn will be quickly recharged by capacitor $C_1$, with the latter being recharged by the $2.1^V$ DC power supply.

The inductances $L_{4,1a}$, $L_{4,2a}$ . . . $L_{4,32a}$, $L_{4,1b}$, $L_{4,2b}$ . . . $L_{4,32b}$, $L_{3a}$, $L_{3b}$, $L_{2a}$, $L_{2b}$, $L_{1a}$ $L_{1b}$, all represent the unavoidable series interconnection parasitic inductance of each charge and discharge path of each capacitor. The circuit also shows the possible sense points for the two power supply sense connections.

From this circuit schematic, it can be readily seen that when one or more lines are switched, significant crosstalk voltage can be injected into other lines. For example, when the line for bit 1 is switched by any transceiver connected to it, the dv/dt of the rising or falling edge of the signal current will generate a voltage across $L_{4,1a}$ and $L_{4,1b}$ which will appear as a pulse at the junction of $R_{t1}$ and $R_{t2}$ and thus on bus line for data bit 2, attenuated as a function of $R_{t2}$ and impedance output $Z_o$ of line 2.

Since capacitors $C_{3,1}$; $C_{3,2}$ . . . $C_{3,n}$ are the primary source of stored energy needed to supply current to the termination resistors, and they will discharge (or charge) at an initial rate determined by the maximum current demand, any voltage change, across these capacitors, due to current drawn by driven lines will appear as crosstalk across undriven lines as well as each driven line seeing the crosstalk from all the other driven lines.

For many general, digital circuit applications, a sufficiently stable voltage source for switched current applications (which typically use feedback amplifiers to provide the necessary currents to maintain a stable voltage) is provided using a conventionally current regulated power supply with a set of low ESR capacitors. For more precise applications, however, this system does not work well.

Use of such low ESR capacitors with the parasitic inductances create resonant frequencies in the feedback of an amplifier of a current regulator causing undesirable ringing of the circuit at the resonant frequencies. The series inductances need to be reduced and a different type of supply, with faster and different response characteristics, is therefore needed to solve the problem.

Until the present invention, it has been difficult to develop a faster response time of a current regulator of a power supply for a backplane system. We believe that the reason a fast responding current regulator has not been developed is because of the high series parasitic inductances. The errors due to the series parasitic inductances, which are partly in the capacitors and partly in the printed circuit interconnections, and the errors due to the equivalent series resistances, which are inherent in ceramic capacitors, are totally unacceptable for the application.

For more precise applications of the power supply of a backplane system, remaining problems include (a) transient response of the current regulator, (b) output impedance and (c) the parasitic inductance between the power supply and the high speed BTL logic devices. Prager, supra, suggests that part of the solution to the problem arising out of parasitics and a DC-DC converter module is to use "external capacitance at the load sites, to overcome control response and transient voltage problems at the point of load, inherent to traditional converters. By having essentially all of the output capacitance outside the converter module, at the points of load, parasitic inductances between the converter and the load are lumped into the output inductance of the converter, thus eliminating constraints on the slew rate of the voltage feeding the parasitics." Thus, the system described by Prager is a "voltage compliant system".

However, applying the teachings of Prager as well as the prior art precision voltage references (as described hereinafter) used for successive approximation analog-to-digital converters in order to provide a fast recovery after the application of a current step function to a backplane system is not satisfactory because of inherent parasitic impedances created in the current paths between the sense points, as well as the load capacitor itself.

OBJECTS OF THE INVENTION

The principal object of the present invention is to overcome or substantially reduce the foregoing problems of the prior art.

A more specific object of the present invention is to provide an improved current regulator for a DC power supply for a backplane system which provides improved, i.e., faster, response characteristics.

Another, more specific object of the present invention is to provide an improved backplane system having an improved power supply, in which the errors due to the series parasitic inductances and the errors due to the equivalent series resistances, which are inherent in ceramic capacitors, are substantially reduced.

Yet another object of the present invention is to provide an improved DC power supply for use with a backplane system which includes a fast responding regulator, both in sensing changes and responding to changes.

Still another object of the present invention is to provide an improved DC power supply for a backplane system which responds faster without undesirable ringing.

Other objects of the invention will in part be obvious and will in part appear hereinafter. The invention accordingly comprises the apparatus possessing the construction, combination of elements, and arrangement of parts exemplified in the following detailed disclosure, and the scope of the application of which will be indicated in the claims.

SUMMARY OF THE INVENTION

In accordance with the present invention, a current regulator includes a current regulating, transconductance amplifier connected to the load capacitor. The load capacitor is connected close to the load inside the feedback loop of the regulating amplifier. The frequency response shaping networks of the amplifier are designed to include the pole and zero, contributed by this capacitor, to meet the criteria for fast settling from a current step into the output.

At least in the location of the load capacitor and the current feedback paths between each sense point and the transconductance amplifier of the regulator the dielectric thickness of the dielectric material is made as thin as possible, consistent with manufacturability and voltage breakdown (currently on the order of seven mils thick), and the current paths between the transconductance amplifier and each of the sense points (for detecting changes in load current) are made parallel to one another on opposite sides of the dielectric material so that the current in the two paths follow equal and opposite parallel directions. This results in the interaction of the electromagnetic fields created by the two currents drawn at the sense points so that they cancel one another so as to reduce the parasitic impedance of these current paths.

BRIEF DESCRIPTION OF THE DRAWINGS

For a fuller understanding of the nature and objects of the present invention, reference should be had to the following detailed description taken in connection with the accompanying drawings wherein.

DETAILED DESCRIPTION OF THE DRAWINGS

Until the present invention, it has been difficult to develop a faster response time of the current regulator of a power supply for a backplane system. We believe that the reason a fast responding current regulator has not been developed is because of the high series parasitic inductances, which are partly in the capacitors and partly in the printed circuit interconnections of the backplane assembly.

Accordingly, there are two aspects to the present invention. In the past the bandwidth of the current feedback regulating system has been governed by the fastest possible recovery response time of the regulator. The first aspect of the present invention relates to a relatively fast current regulator which can be used with backplane systems and respond and settle approximately two orders of magnitude faster than the prior art power supply regulators commonly used with backplane systems. Even more important than its fast settling attribute, is that the delay time to respond to a change of charge in the load capacitors (which supply the initial incremental current to the terminations of the bus) as sensed by the feedback path of the regulator, and provide recharge current to the capacitors, is significantly less than the delay computed from the closed loop bandwidth of the system.

The second aspect of the invention relates to a configuration for significantly reducing the series inductance in the charge/discharge paths of bypass capacitors, particularly those used to minimize the very high speed transients during and after the on/off current transitions that occur during the rise and fall times of the transceivers.

The Very High Speed Current Regulator

An approach was developed approximately thirty years ago for providing a precision voltage reference supply for successive approximation analog-to-digital converters in order to provide a fast recovery after the application of a current step function. This was achieved by placing a capacitor close to the load inside the feedback loop of a regulating operational amplifier and designing the frequency response shaping networks of the amplifier to include the pole and zero, contributed by this capacitor, to meet the criteria for fast settling from a current step into the output. The current regulator of the present invention utilizes such an approach together with the technique of minimizing the parasitic series inductances in the backplane assembly.

Figure 3:
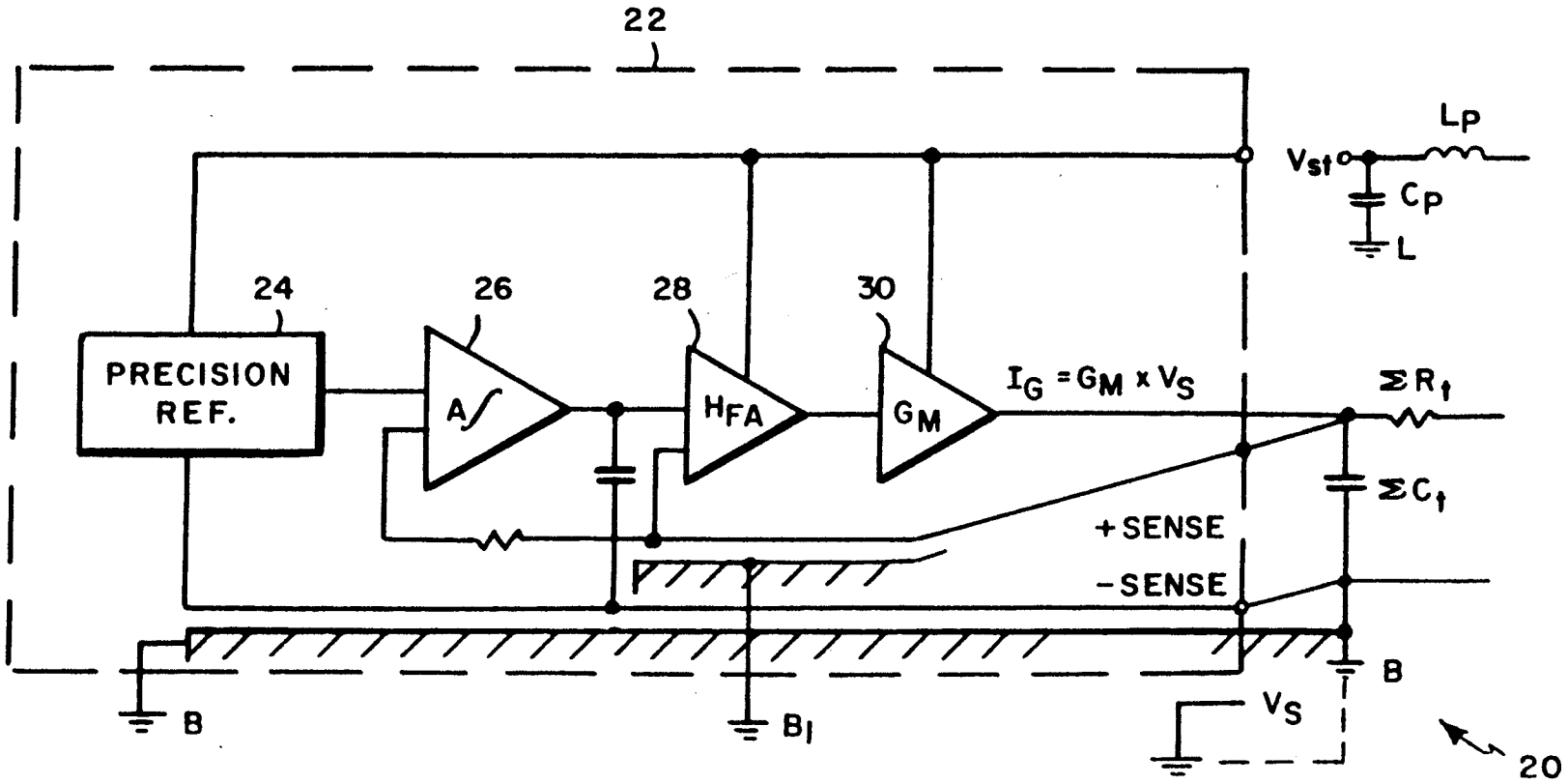
FIG. 3 is a block diagram of a DC power source including the current regulator of the present invention shown connected to a backplane bus.

FIG. 3 shows a block diagram of the power supply designed in accordance with the present invention. The power supply 20 generally includes a current regulator 22. Regulator 22 has its output connected to the load, in this case a plurality of resistors $\Sigma R_t$ connected at each termination end of the busses of backplane assembly. As currently contemplated each current regulator is designed to be connected to as many as 64 data bit lines of a backplane system. As shown in FIG. 3, a small capacitance storage capacitor $C_t$ is placed near each resistor $R_t$ and is connected between the corresponding resistor and the backplane ground, B. All of capacitors $\Sigma c_t$ connected at the output of the current regulator 22 form the output of the regulator. Each power input storage capacitor $C_t$ is preferably isolated, to an appropriate degree, from the power input at frequencies that should be rejected for RFI/EMI radiation purposes, by a device such as an RF choke.

Figure 1:
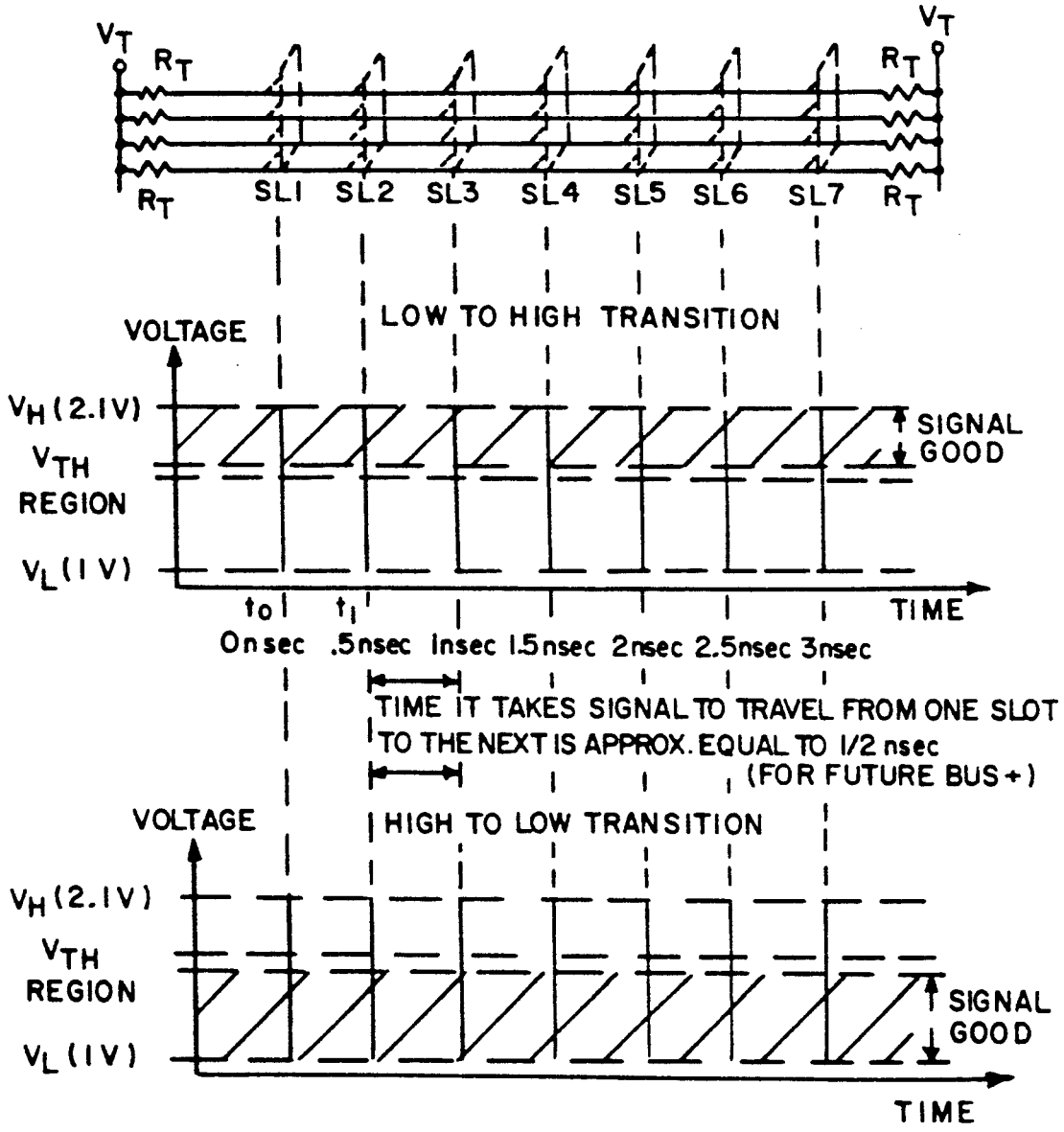
FIG. 1 PRIOR ART
FIG. 1 is a graphical illustration of the various voltage levels of digital signals on a standard backplane bus designed for prior art incident wave switching.
Figure 2:
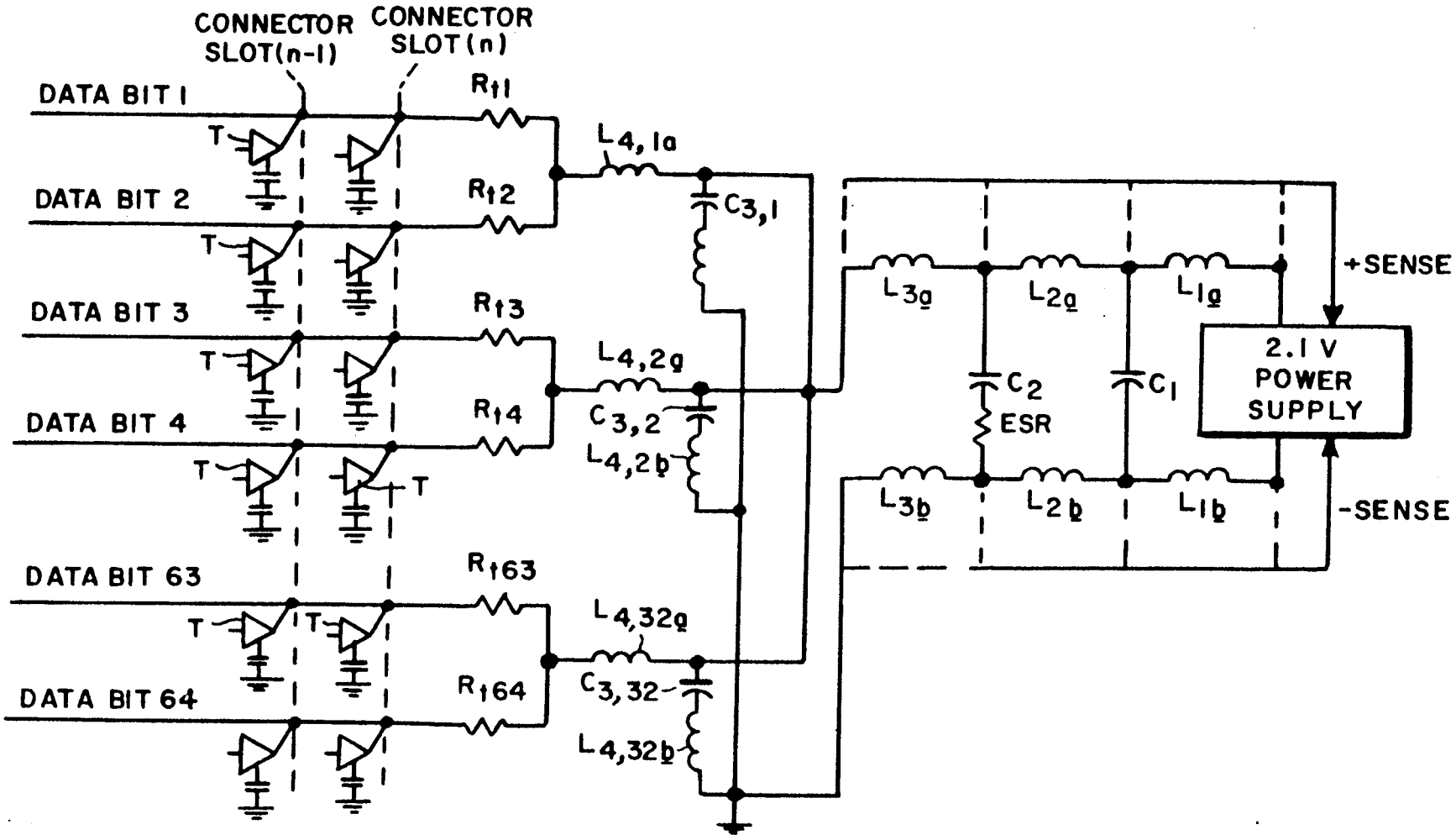
FIG. 2 PRIOR ART
FIG. 2 is a schematic diagram of a prior art DC power supply including a current regulator used in a backplane system.

The regulator 22 also preferably includes means 24 for precisely defining the current voltage reference value. Means 24 is preferably in the form of a precision resistor, connected between the voltage supply $V_S+$ (provided from the backplane) and the backplane ground B. Means 24 thus establishes a stable primary reference voltage. The output of means 24 is preferably a voltage applied to the input of means for defining a long term, more stabilized value of the voltage reference level. The latter means is preferably in the form of low frequency DC drift-stabilizing or integrating amplifier 26 similar to the stabilizing amplifier section of a chopper- stabilized amplifier. Negative feedback of the voltage across the load capacitance $\Sigma C_t$ is also provided to amplifier 26 so that changes in the voltage across the load capacitances are also detected and applied to integrating amplifier 26. The output of amplifier 26 is applied to the input of a wide-band DC-to-VHF (very high frequency) amplifier 28 so as to stabilize the latter. Very high frequency amplifier 28 also receives negative feedback of the voltage across the load capacitance $\Sigma C_t$ so that quickly changing values of voltage across the load capacitance (compared with the stabilized reference voltage) are sensed by amplifier 28. The latter provides a voltage output $v_S$ which is a function of substantially the instantaneous change in the voltage difference. The signal $v_S$ is applied to the input of a wide-band transconductance amplifier 30 with a relatively high output impedance and a transconductance ratio $G_m$ which provides a current output to the capacitors $\Sigma C_t$ equal to the product of $V_S$ and the transconductance ratio $G_m$. The ratio $G_m$ is set so that the amount of current provided to the capacitors will replenish the capacitors with charge when discharge occurs due to a change of state from low to high on any or all of the lines connected to the respective resistors $\Sigma R_t$. The large, main capacitors (shown as $C_1$ and $C_2$ in FIG. 2), are shown schematically as $C_p$ in FIG. 3, and the associated inductances $L_{1a}$, $L_{2a}$, etc of FIG. 2 are shown in FIG. 3 lumped as $L_P$.

Thus, the current regulator includes a wide band DC-to-VHF amplifier of relatively stable gain feeding a transconductance device to create a very wide band transconductance amplifier of known Gm within reasonably stable limits. The output current of this device flows into the switched termination resistors $\Sigma R_t$ and the primary transient capacitors $\Sigma C_t$ (shown respectively as $R_{t1}$, $R_{t2}$ . . . etc. and $C_{3,1}$; $C_{3,2}$ . . . etc. in FIG. 2, with these devices being shown in FIG. 3 lumped together as $\Sigma R_t$ and $\Sigma c_t$) which determine the output voltage and thus the open loop voltage gain of the power supply as a function of the transconductance ratio, $G_m$.

Thus, a regulator with a wide, but manageable, bandwidth has been achieved, yet its response time to supply current to the load is one to two orders of magnitude faster than would be determined by the bandwidth of the feedback loop as would be the case with prior state of the art devices.

Figure 4:
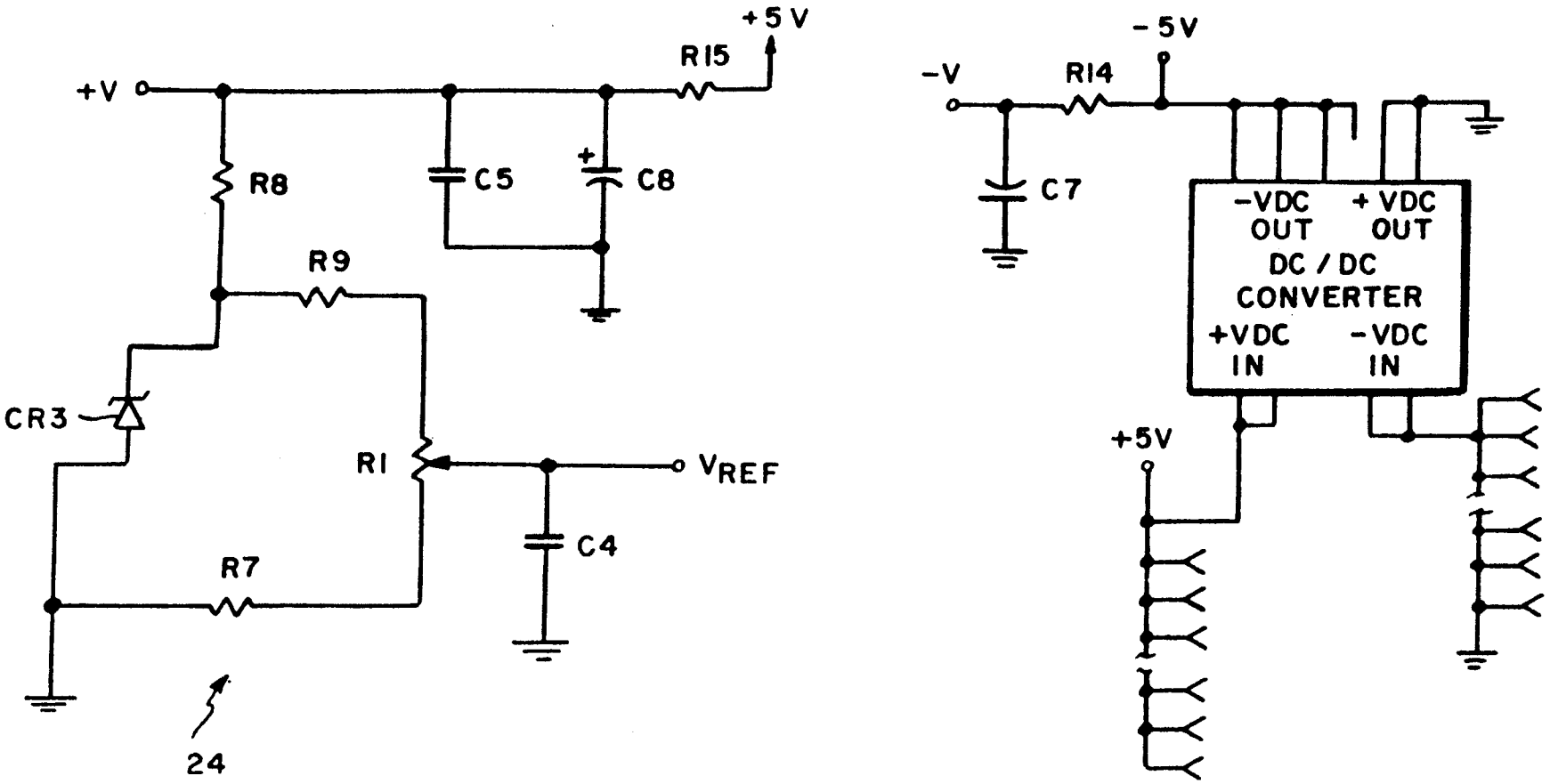
FIGS. 4 and 5 are more detailed partial schematic and partial block diagrams of the preferred DC power source of present invention.
Figure 5:
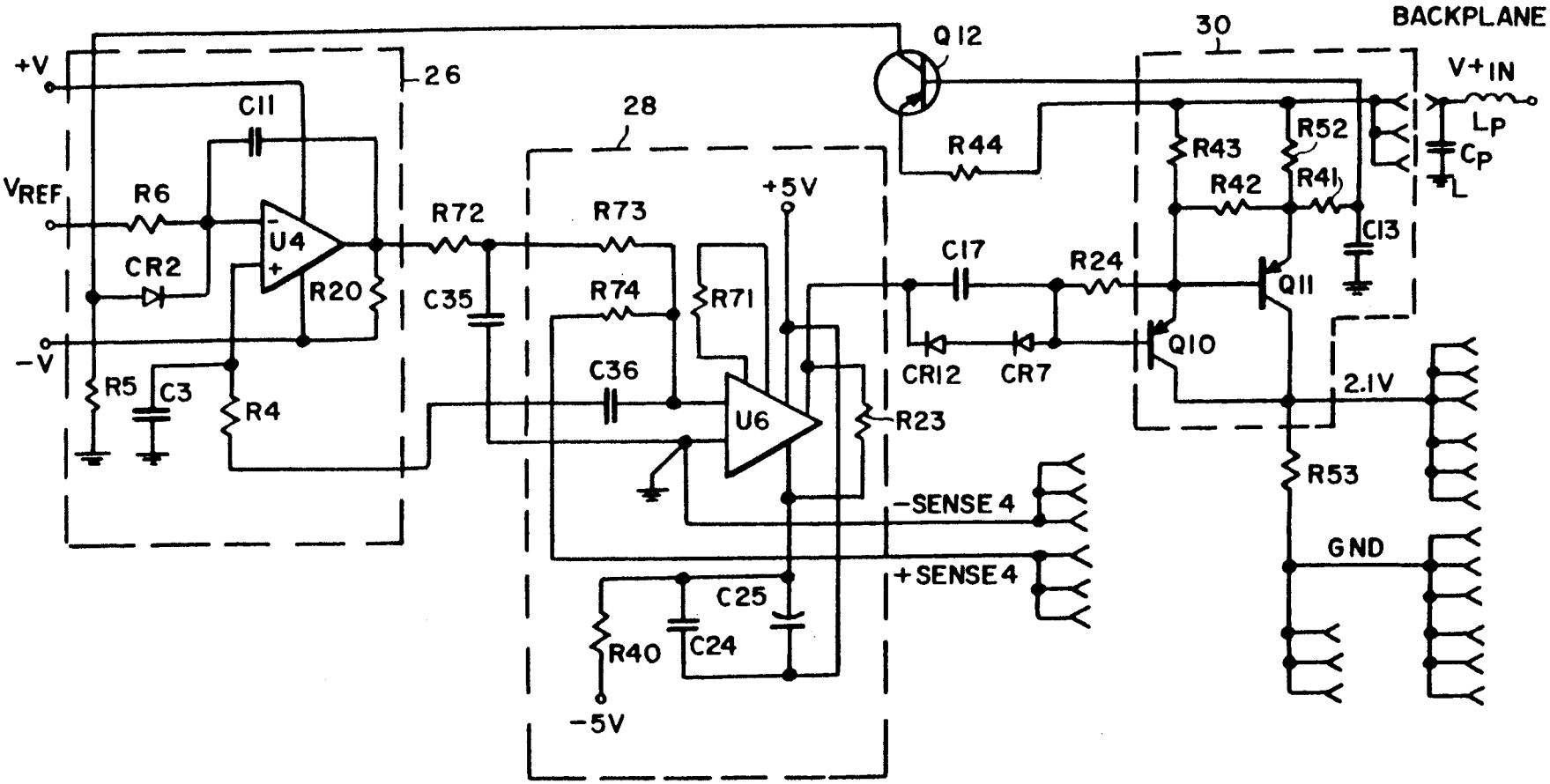

A more detailed schematic of the power supply is shown in FIGS. 4 and 5. In FIG. 4, means 24 is shown as including a Zener diode $CR_3$ for establishing a reference voltage across the precision resistor $R_1$. A DC of $+5^V$ is provided to resistor $R_{15}$, which in turn is connected through the noise filter formed by capacitors $C_5$ and $C_8$ to provide the voltage V+ across resistor $R_8$ and the Zener diode $CR_3$. Resistor $R_1$ is a variable trim resistor with its tap connected to the output of means 24 for providing the $V_{ref}$ output. A DC-to-DC converter $U_1$ provides a stable $-5^V$ DC and backplane bus ground, L. A $-5^V$ DC is applied through a noise filter formed by resistor $R_{14}$ and capacitor $C_{17}$ so as to provide the −V DC reference. The outputs of the precision reference 24 and converter $U_1$ are used to provide the necessary voltages to each of the current regulators used in a backplane system.

Referring to FIG. 5, each current regulator is provided with operational amplifier U4, which when connected as shown forms the low frequency DC drift stabilizing integrating amplifier, for defining a long term, more stabilized value of the voltage reference level. Specifically, the $V_{ref}$ signal is applied through resistor $R_6$ to the inverting input of amplifier $U_4$, the inverting input being biased to ground through diode $CR_2$ and resistor $R_5$. A voltage is provided to the junction of the diode $CR_2$ and resistor $R_5$ from the collector of transistor $Q_{12}$ (which is provided for short circuit protection), with the emitter of the latter being connected through resistor $R_{44}$ to the $V_S$in+ source from the backplane system. The non-inverting input of $U_4$ is connected through capacitor $C_3$ to ground, and through resistor $R_4$ to the capacitor $C_{36}$, which in turn is connected to the non-inverting input (the feedback input) of the differential amplifier $U_6$ of the very high frequency amplifier 28.

The output of amplifier $U_4$ is connected through feedback capacitor $C_{11}$ to its inverting input, through resistor $R_{20}$ to −V, and through resistor $R_{72}$ to the resistor $R_{73}$ (which in turn is connected to the non-inverting input of amplifier $U_6$) and the capacitor $C_{35}$ (which in turn is connected to the inverting input of amplifier $U_6$).

Feedback of the voltage across the load capacitance $\Sigma C_t$ is provided to means 26 via the +SENSE line to the non-inverting input of the amplifier $U_4$, and to the non-inverting input of amplifier $U_6$. Thus, changes in the voltage across the load capacitance are detected and applied to the integrating amplifier as well as the high frequency amplifier. The feedback of the voltage level at the load capacitance $\Sigma C_t$ at the ground plane is provided over the −SENSE line to the inverting (reference) input of the differential amplifier $U_6$. Amplifier $U_6$ has resistor $R_{71}$ connected between pins 2 and 7, its power input pin 6 connected to the $+5^V$ source of the DC-DC converter, its power input pin 3 connected through resistor $R_{23}$ to a positive output of the amplifier and through resistor $R_{40}$ to the $-5^V$ source of the DC-DC converter, and through each of the capacitors $C_{24}$ and $C_{25}$ to the $+5^V$ source of the DC-DC converter. The latter is connected through resistor $R_{44}$ to the emitter of transistor $Q_{12}$, and to the $V_S$in+ source from the backplane. The output of pin 4 is connected to a DC voltage level shifter, generally designated as 32, which shifts the voltage output so that the correct voltage level can be applied to the input of the transconductance amplifier.

The level shifter has one plate of the capacitor $C_{17}$ and the cathode of diode $CR_{12}$ connected to the pin 4 of differential amplifier $U_6$. The opposite plate of capacitor $C_{17}$ is connected to the anode of diode $CR_7$, which in turn has its cathode connected to the anode of $CR_{12}$, to the resistor $R_{24}$, and to the base of transistor $Q_{10}$ forming a part of the transconductance amplifier 30. The emitter of transistor $Q_{10}$ is connected to the base of transistor $Q_{11}$ of the transconductance amplifier so that the transistors $Q_{10}$ and $Q_{11}$ are cascaded, and to resistors $R_{24}$, $R_{42}$ and $R_{43}$. Resistor $R_{43}$ is connected to the $V_S$in+ source, while resistor $R_{42}$ is connected to resistors $R_{41}$ and $R_{52}$, which in turn are also each connected to the $V_S$in+ source, and to the emitter of transistor $Q_{11}$. The emitter of transistor $Q_{11}$ is in turn connected through resistor $R_{41}$ to the grounded capacitor $C_{13}$, and to the base of transistor $Q_{12}$. Finally, the collectors of transistors $Q_{10}$ and $Q_{11}$ are tied together to form the output of the current regulator, which is connected to ground through the resistor $R_{53}$.

The $V_S$in+ source is preferably provided by a power input storage capacitor $C_P$ and the isolating choke $L_P$ of the backplane system so as to provide a transient power source for the regulator. The capacitor $C_P$ is connected to the backplane signal bus ground at the termination end of the busses and allows the regulator ground to be totally connected to this bus ground instead of the general power and logic ground. Separation of the power/-logic ground from the bus ground can be very important for a number of reasons. Typically, they will be connected together at one place or along one axis perpendicular to the signal bus runs. Carelessly placed power bypass capacitors can spoil this isolation at critical frequencies. A particularly important reason is to prevent the bus ground shift voltages from appearing on the logic grounds of the function boards because they can contain a frequency spectrum that spans frequencies which should not be radiated for RFI/EMI reasons. In this case the junction of the two grounds would be the neutral point which should also be connected to chassis and "earth" ground.

Figure 6:
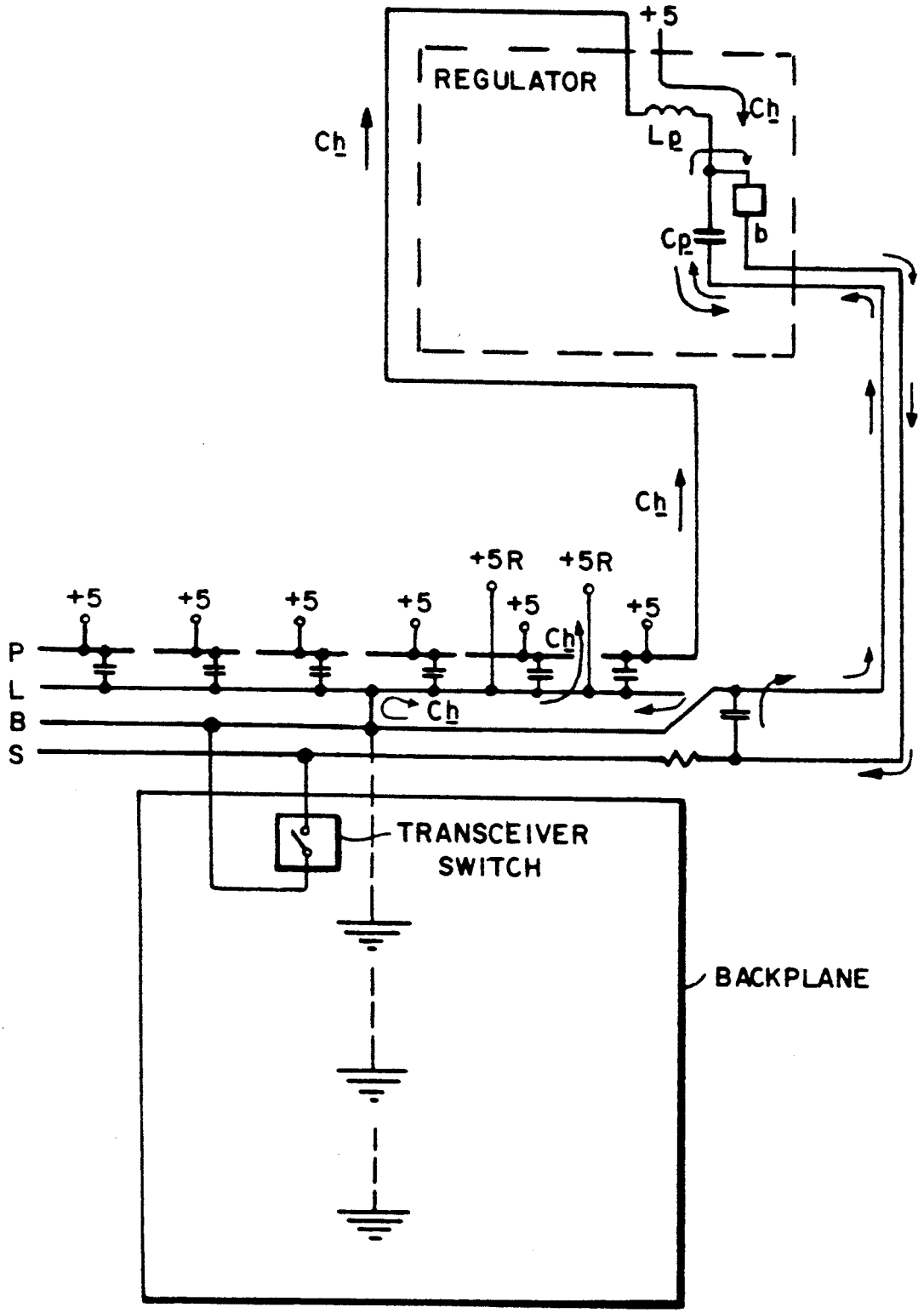
FIG. 6 is a partial block and partial schematic diagram of the charge and discharge that occurs in response to changes in signal state on the backplane bus.

FIG. 6 shows the path of the transient currents supplied by $C_P$ (unmarked arrows) and the path of the capacitor $C_P$ charging current (arrows marked ch) . This configuration forces the return currents of the very fast response output of the transconductance amplifier to follow a "mirror" path on the ground plane under the forward current path, in the manner of a very low impedance, high current power transmission line, to minimize inductive effects. This is also indicated diagrammatically in FIG. 3 and is described in greater detail hereinafter.

Figure 8:
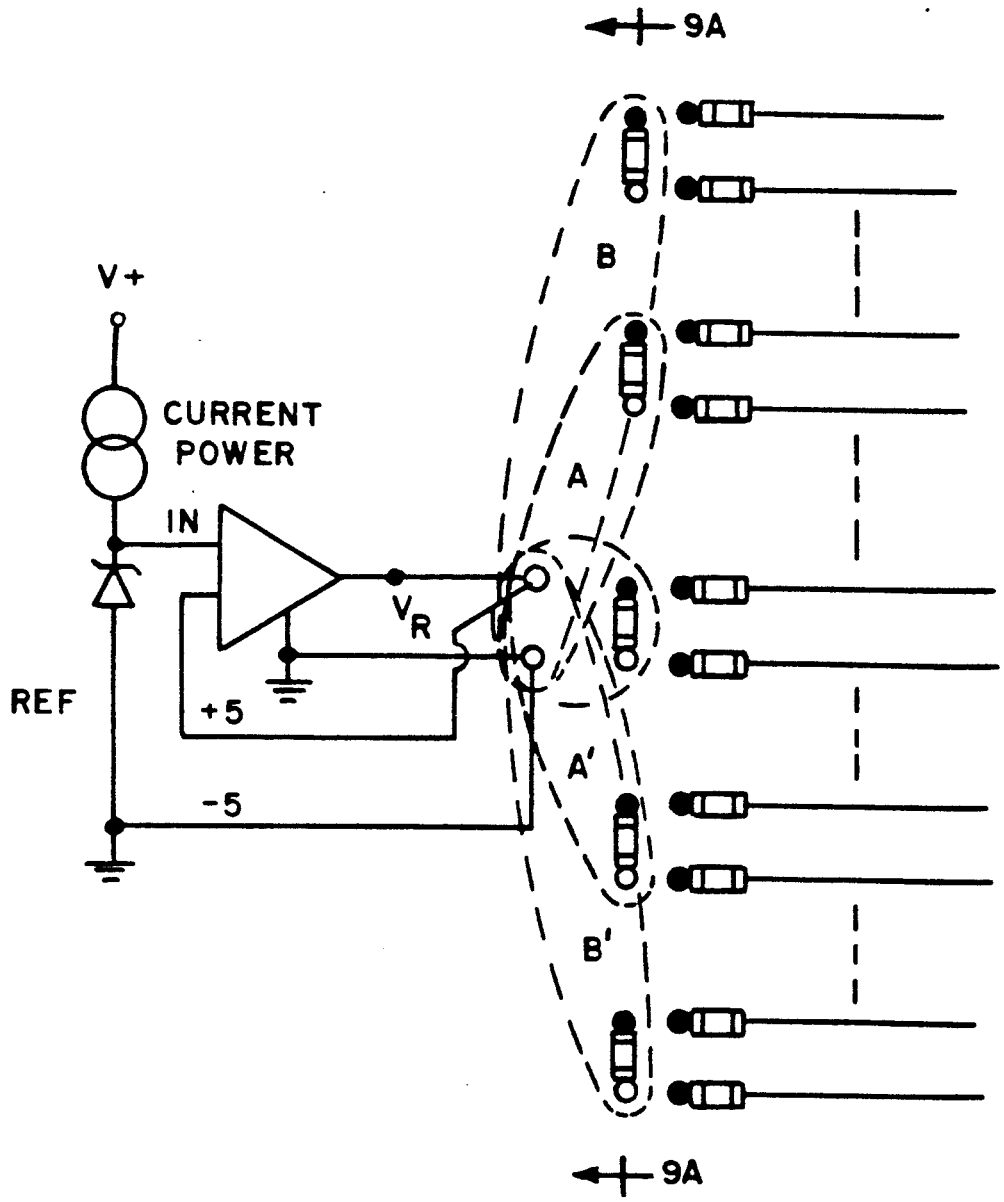
FIG. 8 shows a schematic top view of a backplane in order to illustrate the operation of the current regulator of the present invention.

FIG. 8 also shows the novel arrangement for high speed sensing. The return sense line preferably does not return to the input of the very high speed differential amplifier as just a separate etch line on the printed circuit board. It preferably does so as a mirror current on a separate section of ground plane thus providing a matched, terminated line to prevent inductive or reflective resonant effects and cross coupling that could cause oscillations.

Configuration for Reduction of Power and Ground Inductive Effects

Figure 7:
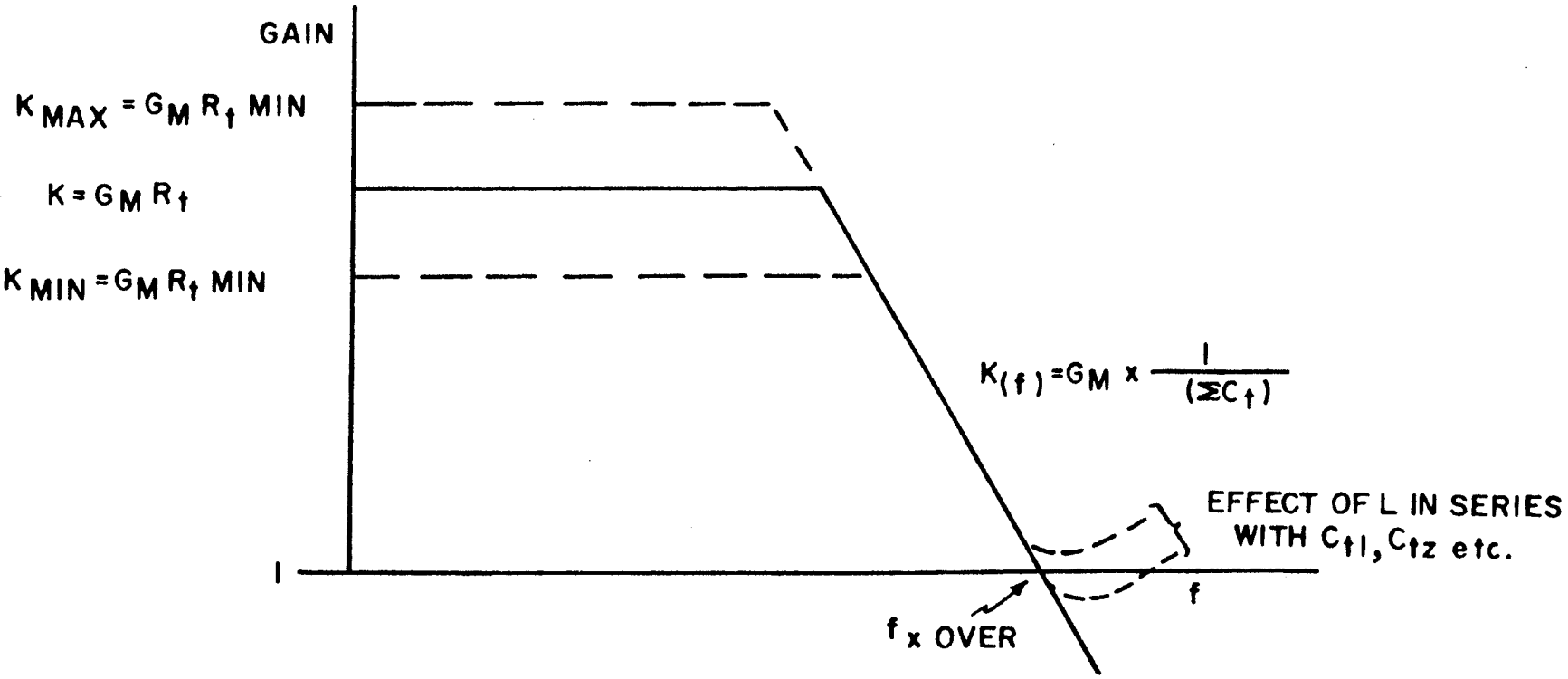
FIG. 7 illustrates a graphical representation of the gain of the transconductance amplifier used in the present invention as a function of frequency.

As explained previously and illustrated in FIG. 2, currents switched on to one group of termination resistors, as the corresponding bus lines turn on, will inject crosstalk signals into other signal lines as a result of voltages generated across unwanted inductances (as shown in FIG. 2). For instance, FIG. 8 shows that voltage drops in current path B can affect the bus line pairs m or n or any in between. Likewise path B' can affect m' or n' or any in between. FIG. 8 should be referred to in conjunction with FIG. 7 which, in turn, shows that the response and the stability of the voltage feedback loop are determined by the transconductance ratio (Gm) and the impedance between the sense points shown in FIG. 8. If this impedance is pure capacitance, the result is the ideal 6 db/octave response of FIG. 7. If, however, this impedance includes appreciable amounts of series inductance the response can be modified to curve up in the vicinity of the crossover frequency as shown by the dotted lines near (fxover): To put this in perspective, "appreciable inductance" would be in the high picohenry to low nanohenry range.

Figure 9A:
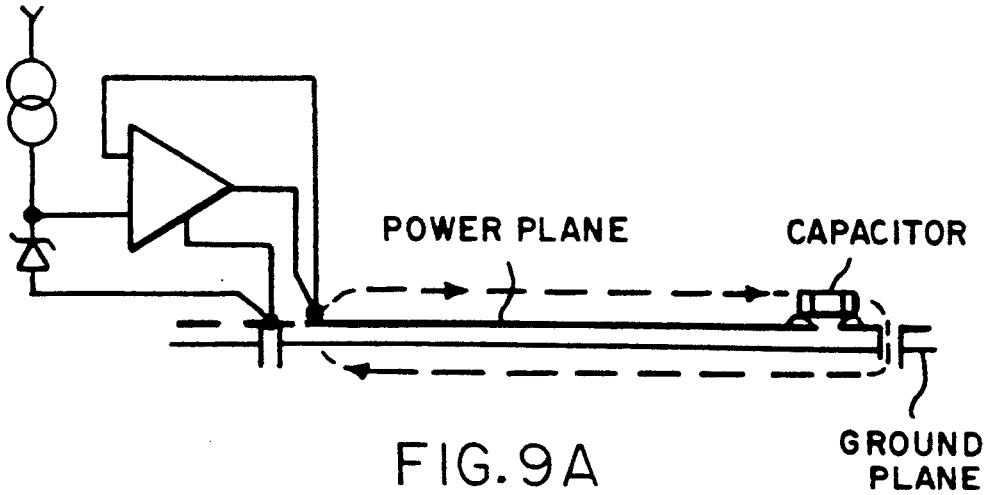
FIGS. 9*a* and 9*b* show a cross sectional view of the backplane assembly in FIG. 8 in order to illustrate the reduction of parasitic inductance.
Figure 9B:
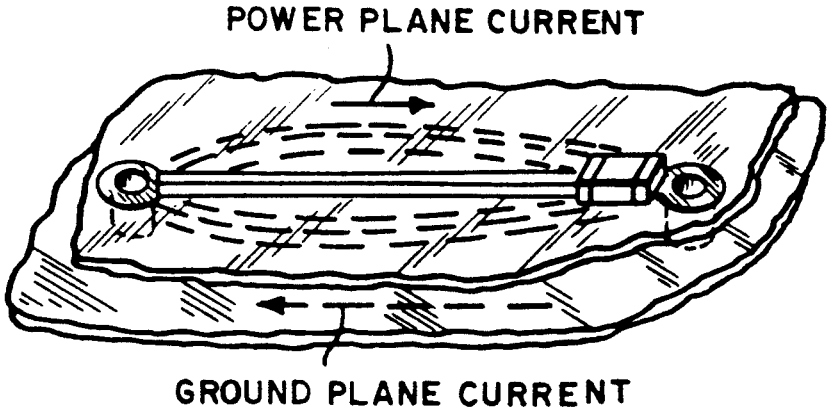

Reducing the Series Inductance in the Charge/Discharge Paths of Bypass Capacitors The configuration developed to reduce the series inductance to acceptable levels causes the ground return current from each capacitor to flow back to the source (in this case the sense points on the charge current path) as a "mirror current" (FIGS. 3 and 9) directly under and parallel to the forward current path on the power plane.

Figure 10:
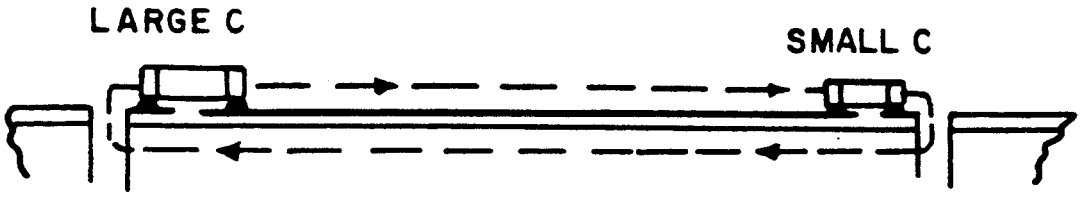
FIG. 10 is a side view in cross section showing parallel current flow on the two parallel planes of the bus system between two capacitors in order to show the cancellation of the electromagnetic fields, and thus a reduction, or substantial elimination of parasitic impedance.

This is achieved by locating the sense points very close together, the capacitor terminals very close together and reducing the dielectric thickness of the dielectric material between the power and the ground plane to the minimum amount consistent with manufacturability and voltage breakdown. Currently, a dielectric thickness as small as seven mils has been satisfactory. The interaction of the electromagnetic fields of the two currents reduces the impedance of these current paths significantly below that of any paths that are outside these boundaries thus keeping the currents within the desired boundaries. FIG. 10 shows the equivalent for flow between two capacitors. This is usually somewhat less critical than the situation shown in FIG. 5.

To achieve this-configuration with the minimum quantity of printed circuit layers, the ends of the planes, outside the signal layers and their surrounding ground planes, are segmented off and reassigned to achieve the optimum configuration for the termination system.

The present invention therefore provides for an improved current regulator particularly adapted for a DC power supply for a backplane system. The regulator provides improved, i.e., faster, response characteristics, and the need for ceramic capacitors so that errors due to the series parasitic inductances and the errors due to the equivalent series resistances, which are inherent in ceramic capacitors, are substantially eliminated so as to eliminate undesirable ringing. The frequency response of the preferred embodiment is on the order of 5 MHz, although the precise response is a matter of choice and design. The improved DC power supply includes a fast responding regulator, both in sensing changes and responding to changes. Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In a backplane system employing BTL transceivers in data lines for selectively coupling each said line to a bus through a load comprising respective termination resistance means connected through load capacitors each of relatively low capacitance to a main capacitance of relatively high capacitance chargeable by a power source to establish a logic high level, a current regulator comprising, in combination, a precision, stable, primary reference voltage source;

a relatively low frequency, low DC drift integrating amplifier means having its input connected to the output of said voltage source;

a wide-band DC-to-VHF amplifier means with relatively stable gain, and having its input connected to the output of said integrating amplifier means; and a wide band transconductance amplifier having its input connected to the output of said wide-band amplifier means, said transconductance amplifier having a relatively high output impedance and a transconductance ratio Gm;

said main capacitance being connected to the output of said transconductance amplifier and being substantially isolated from the input of said transconductance amplifier at frequencies that should be rejected for RFI/EMI radiation purposes.

2. A combination as defined in claim 1 wherein said transconductance amplifier includes frequency response shaping networks that include the pole and zero contributed by said load capacitors so as to meet the criteria for fast settling from a current step at said load.

3. A combination as defined in claim 1 wherein said transconductance amplifier includes a negative feedback path from the output terminal thereof to an input terminal thereof, the bandwidth of said transconductance amplifier means being an order of magnitude or more greater than the bandwidth required for Nyquist stability of said transconductance amplifier means.

4. In combination with a backplane system defining at least one load and having at least two conductive planes separated by a dielectric material, a current regulator comprising:

a current-regulating, transconductance amplifier coupled to said load and including frequency response shaping networks and at least first and second current feedback paths from positive and negative sense points at or near said load;

a load capacitance connected adjacent said load inside the feedback loop between said positive and negative sense points;

said frequency response shaping networks including the pole and zero contributed by said load capacitance so as to meet the criteria for fast settling from a current step at said load; and at least in the location of said load capacitance and said current feedback paths between each said sense point, each of said feedback paths being disposed parallel to one another on opposite sides of said dielectric material and the dielectric thickness of said dielectric material between said feedback paths being sufficiently thin so that the respective currents in said feedback paths follow opposite parallel directions and the electromagnetic fields created by said currents cancel one another.

5. The combination of claim 4, wherein said transconductance amplifier comprises:

means for providing a stabilized DC reference voltage;

means, responsive to said stabilized DC reference voltage, for providing a voltage as a function of change of the instantaneous voltage sensed across said load capacitor; and means for providing a current to said load capacitor in response to changes in voltage sensed across said load capacitor.

6. The combination of claim 5, wherein said means for providing a stabilized DC reference voltage includes a precision resistor.

7. The combination of claim 5, wherein said means for providing a voltage as a function of change of the instantaneous voltage sensed across said load capacitor includes a high frequency, differential amplifier.

8. The combination of claim 5, wherein said means for providing a current to said load capacitor in response to changes in voltage sensed across said load capacitor, includes a transconductance amplifier.

* * * * *